United States Patent [19]

St. Germain

[11] Patent Number: 4,850,629

[45] Date of Patent: Jul. 25, 1989

[54] MULTIPLE PATH SLING CONSTRUCTION

[76] Inventor: Dennis St. Germain, 358 High Ridge Rd., Chadds Ford, Pa. 19317

[21] Appl. No.: 152,340

[22] Filed: Feb. 4, 1988

[51] Int. Cl.[4] ..... B66C 1/18

[52] U.S. Cl. ..... 294/74

[58] Field of Search ..... 294/74; 57/201, 210; 112/417, 420, 440, 441

[56] References Cited

U.S. PATENT DOCUMENTS

| | | | |
|---|---|---|---|
| Re. 26,704 | 11/1969 | Norton | 294/74 |
| 2,960,365 | 11/1960 | Meisen | 294/74 |
| 3,718,945 | 3/1973 | de Treglode | 294/74 X |
| 3,899,206 | 8/1975 | Miura | 294/74 |
| 4,116,481 | 9/1978 | Raue | 294/74 |
| 4,210,089 | 7/1980 | Lindahl | 294/74 X |
| 4,421,352 | 12/1983 | Raue et al. | 294/74 |

FOREIGN PATENT DOCUMENTS

| | | | |
|---|---|---|---|
| 3304527 | 8/1984 | Fed. Rep. of Germany | 294/74 |
| 244536 | 4/1987 | German Democratic Rep. | 294/74 |
| 1050789 | 12/1966 | United Kingdom | 294/74 |
| 1241849 | 8/1971 | United Kingdom | 294/74 |
| 2044726 | 10/1980 | United Kingdom | 294/74 |
| 8402510 | 7/1984 | World Int. Prop. O. | 294/74 |

*Primary Examiner*—Johnny D. Cherry

*Attorney, Agent, or Firm*—Anthony J. McNulty

[57] ABSTRACT

The lifting sling of this invention comprises multiple discrete sling cores formed from a plurality of longitudinally extending parallel segments which are each contained inside separate cover material which form paths or channels arranged in an endless tubular loop. At least two separate sling cores are protected inside separate longitudinal endless paths of cover material which is sealed or fastened to prevent contact between the sling cores.

9 Claims, 3 Drawing Sheets

MULTIPLE PATH SLING CONSTRUCTION

The multiple path sling of this invention comprises at least two lifting cores which are inside tubular endless covers which form separate and discrete paths for each lifting core which extend longitudinally in parallel to each other. This invention comprises at least two complete side by side load lifting slings. Safety is the most significant feature of this invention. Each separate lifting core in each subcomponent sling makes separate contact between hook and load; each lifting core may also be protected by a cover or by multiple layers of cover material which may employ a color code as a safety warning signal for the user.

BACKGROUND OF THE INVENTION

Unlike the prior art, the sling of this invention has no seams of overlapping protective cover material which are fastened together by extending a seam which penetrates through said cover material and the inner lifting core material. There was great concern in the prior art about the rupture of said seams or stitches when they engaged a load bearing against the sling. There was no concern about keeping multiple sling cores separated from each other because the prior art did not even envision the product of this invention which employes a multiple sling construction comprising discrete separated lifting cores.

In the prior art, Lindahl U.S. Pat. No. 4,210,089, shows a lifting sling having a single inner core which is divided or spaced apart from itself inside of a protective cover which has its edges connected by a seam which penetrates diametrically through the sling core material. This prior art sling suffers in practical usefulness because it is only a single core and has no safety back-up core in case there is damage to or a defect in the single core which reduces the load lifting capacity of the sling, or indeed, which renders it totally useless.

In the present invention, there are two separate sling cores which are independent of each other and which provide a safety back-up for each other. In addition, in this invention, the means for separating the twin paths does not rely on any device which penetrates the sling core material.

SUMMARY OF THE INVENTION

It is an object of this invention to construct a sling for carrying loads which comprises at least two load lifting core components which are contained in separate paths or channels of a cover material. There are at least two complete slings in the construction. Each sling makes separate connections between hook and load. The cover material may be a single layer or multiple layers.

The sling cores of this invention are not interconnected, nor are they connected to said cover material. No fastening or sealing means penetrates the load bearing core components of this sling construction which is made clear in the drawings.

The multiple path sling construction of this invention is flexible and is useful for vertical, basket or choker lifts; it will conform to the shape of hooks or shackles which may be too small for prior art slings. Since the product of this invention is an endless loop, its wear points can be shifted to provide longer wear. The cover material may be selected from any group of materials, including some which are resistant to acid conditions.

In the preferred embodiment of this invention, the cover which forms the paths for the lifting cores and which separates said cores is fastened or sealed lengthwise down its center without penetrating the core materials. The most preferred embodiment of this invention is a construction which comprises an inner and outer cover which envelop two or more sling cores. This assembly is shown in the drawings. Said cover material may be made of material or synthetic polymer, such as Kevlar aramid fiber and suchlike; a flexible metallic cover material can be used for certain applications. Said cover can be seamless, or have a seam along its center or its edge. Said seam may be placed down the center of the construction between cores wherein stitches are embedded in a trough.

The core material of this invention may be comprised of single filament fiber material.

The sling of this invention comprises more than one lifting sling in the construction. Each component lifting sling has its own integrity and will hold a load even if another component sling should fail, provided the load lifting capacity of the surviving sling is sufficient to hold the load which was being supported by the total construction apparatus.

Since the coverings for the sling core material in this invention are tubular, there is no need to fasten any overlapping ends of covers; and since there are two segregated cores which exist separated from each other inside two different paths of the sling construction of this invention, there is no need for fastening means to penetrate the core material because they are located in their separate paths or channels or to connect the ends of the protective cover material because such tubular covers are endless. The separate core materials of this invention remain intact and are not penetrated by any device or material for any purpose.

The color code safety feature of this invention is achieved by the use of different colors for each tubular outer protective covering material. For example, the outer cover could be green or blue and the inner cover could be orange or red; since the inner cover is a different color from the outer cover, it will show through whenever the outer cover is cut or worn through. This provides a visible safety warning for the user of the sling.

As stated above, the main safety feature of the sling of this invention is the existence of multiple sling lifting cores which serve as a load lifting back-up for each other. There is also relative ease of handling of the sling construction of this invention because there is less bulk; a single core sling of the same load lifting capacity would have greater bulk concentrated in its lifting core and would be more difficult to handle.

Still another advantage of this invention is that the apparatus does not have to be removed immediately from use even if the outer protective cover appears to be damaged, torn, snapped, fractured, cut or punctured. The color coded inner cover still protects the lifting core even when the outer cover has been damaged.

The sling apparatus of this invention is easily adapted to fit hooks or shackles that may be too small for other type slings, but even in such cases the slings of this invention provide the widest possible bearing contact with the load. The extra flexibility of the slings of this invention permits them to be handled easily and stored in somewhat restricted spaces.

This invention is described with more detail in the accompanying drawings which show a sling in five figure representations. Other objects of this invention will become apparent when the following description is taken in conjunction with the drawings:

Figure 1:
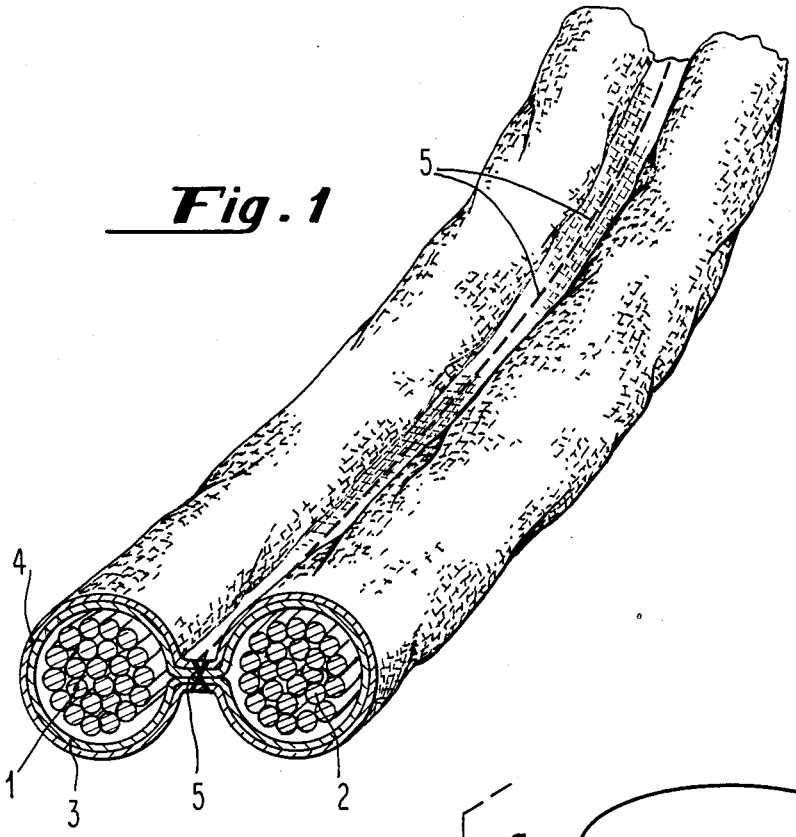
FIG. 1 is a plane view of a section of the continuous sling construction of this invention.

The multiple path sling construction of this invention comprises at least two lifting cores 1 and 2 as shown in FIG. 1 which are located in paths formed by a protective cover material or materials 3 and 4 which in FIG. 1 shows an inner cover 3 and and outer cover 4 which have been fastened longitudinally along their centers by fastening means 5 which prevents interconnection of said cores 1 and 2. The fastening of said protective covers may be done by any conventional method, such as stitching, seaming, stapling, gluing, hot melt adhesive and suchlike.

As stated above, the core material may be selected from high tensile strength fibers, threads, yarns which are suitable for lifting heavy loads; in general such cores comprise parallel threads or strands of such fibers or yarns.

Figure 2:
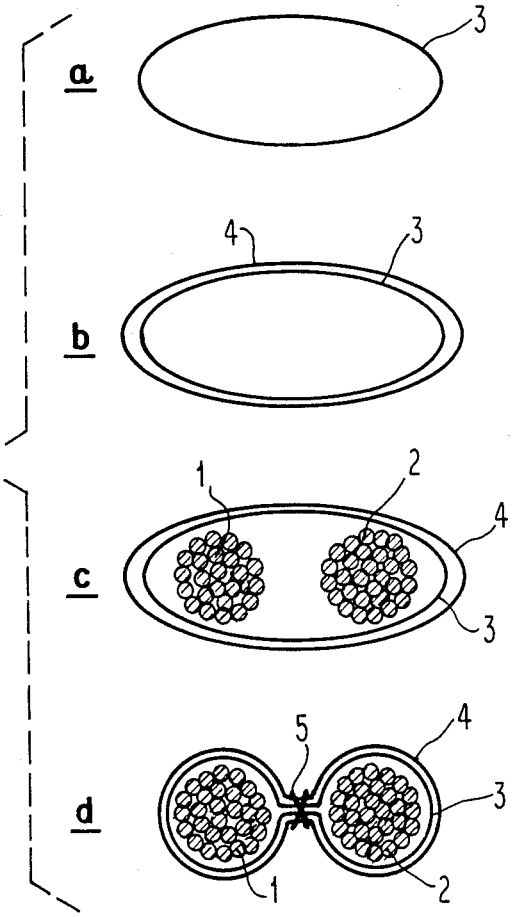
FIG. 2 is a cross-section view of the sling of FIG. 1 which shows two separate cores of material contained in two separate tubular twin paths or conduits each having an inner and outer cover which conduits are separated by a valley which is fastened closed.

As shown in FIG. 2, the lifting cores 1 and 2 are inserted in their protective cover, 3 in FIG. 2*a*, or covers, 3 and 4 in FIG. 2*b*, and separated from each other, FIG. 2*c*, during which separation their discrete paths are formed by fastening said cover longitudinally down the center, 5 in FIG. 2*d*, so that said cores do not interconnect and there is no penetration of said core by such fastening means.

In FIG. 2, there is depicted the preferred method for forming the multiple path sling construction of this invention which comprises first inserting the inner protective cover 3 shown in FIG. 2*b*, inside the outer protective cover 4 shown in FIG. 2*b*, secondly, inserting at least two sling cores 1 and 2 inside said concentric protective covers 3 and 4, thirdly, maintaining said cores in longitudinal separation as shown in FIG. 2*c* by any suitable means, while fourthly fastening said protective covers down their longitudinal centers, 5 in FIG. 2*d*, to form paths or channels which envelop said cores and maintain them in parallel relation to each other as shown in FIG. 2*d*.

In this invention the outer cover 4 and inner cover 3 are loose relative to the core; there is an added advantage gained from this because it reduces damage to the cores and to the covers. This added advantage is especially exhibited when the core material is made of Kevlar which does not stretch as much as other fabrics; there is a safety feature achieved because the snap-back factor is reduced since the protective cover is loose. This feature of the product of this invention could save lives.

Figure 3:
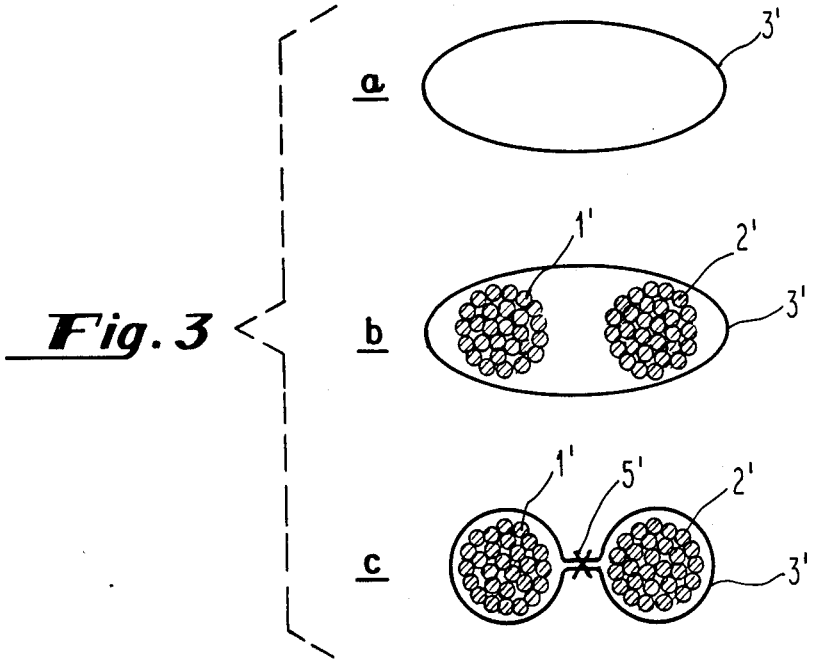
FIG. 3 is a another cross-section view of the sling of FIG. 1 which shows another embodiment of this invention in which said paths are comprised of only a single layer of cover material.

In FIG. 3, there is a representation of a single protective cover, 3' in FIG. 3*a*. The method of fabricating this alternate sling construction is shown in FIGS. 3*a*, 3*b* and 3*c* and is similar to the method described above for the preferred embodiment. In FIG. 3, the numerals 1' and 2' used in 3*b* and 3*c* identify load bearing core means; the numeral 3' used in 3*a* and 3*c* identifies a protective cover means which envelops said core means; the numeral 5' identifies fastening means for closing said cover means along an intermediate portion between said core means in order to maintain them in separate and distinct parallel relationship to other core means.

Figure 4:
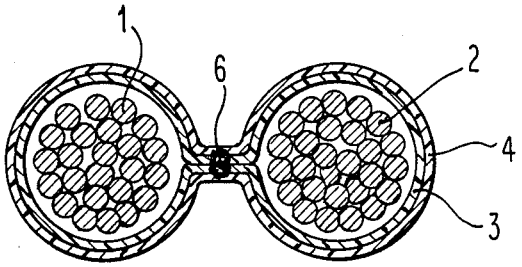
FIG. 4 is still another cross-section of the sling of FIG. 1 which shown an alternate means for fastening the inner and outer covers of said twin paths.

FIG. 4 shows an alternate method for bonding the protective covers 3 and 4 by means of a hot melt bonding adhesive material, 6, which is commercially available. Another alternate bonding means is to use rivets; in certain cases where a flexible metal protective cover is used, then standard fasteners for metals may be used. Consistent with such an alternate embodiment, the lifting sling core material may also be produced from flexible metal materials which are suitable for such usage.

Figure 5:
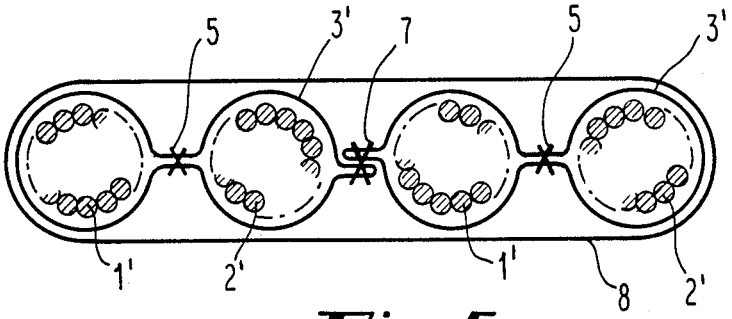
FIG. 5 is a plane view of a multiple part heavy duty sling of this invention.

FIG. 5 shows a heavy duty multiple path sling construction which comprises the bonding of at least two twin path slings of this invention to each other to form a product of greater lifting capacity. The heavy duty sling shown in FIG. 5 is enveloped by a protective cover, 8, which covers the entire sling construction. In FIG. 5, the numeral 7 identifies fastening means for constructing a heavy duty lifting sling which comprises bonding one side of cover means for a single sling construction of this invention to one side of cover means for a second sling construction of this invention.

Fastening means as illustrated by numeral 5 in FIG. 1 can be used in place of the fastening means illustrated by numeral 7 in FIG. 5. for fastening said cover means along their endless loops and the intermediate portions parallel between the core means.

Figure 6:
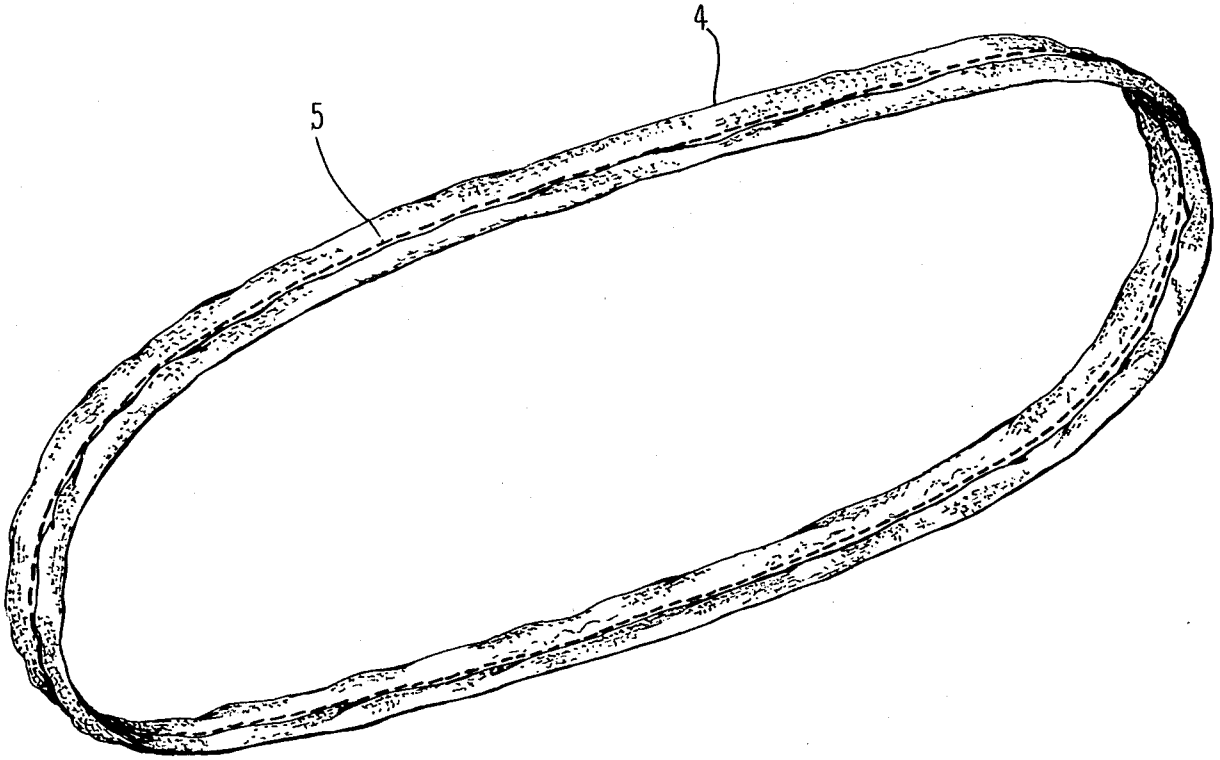
FIG. 6 is a perspective view of the endless sling of this invention.

FIG. 6 is a perspective view of the sling construction of this invention which shows the outer cover means in an endless loop; numeral 8 identifies the fastening means through the cover means which separates the load bearing core means inside the cover means. Standard means may be used for joining said protective covers to form a heavy duty sling, e.g. interrupted discontinuous stitches, continuous seams, spot fastening, sewing, heat sealing; since said covers do not have any edges to fasten together, the main purpose for bonding the covers along their longitudinal center is to separate the sling cores from each other so they remain in their own path or channel without slipping over into the channel of an adjacent parallel sling core. This separation provides for the use of separate slings as part of the same sling construction and thereby reduces exposure to a total failure when conditions cause damage to a particular sling core by a sharp edge or corner. This construction also reduces the danger of snap-back when the sling is subjected to a load which exceeds its load capacity. The core materials of this invention are generally arranged in first and second spaced longitudinally extending sections of substantially equal size and of substantially equal stretch, although there will be some variations of stretch among the different parallel core segments or sections which may occasionally interconnect per individual core; said individual cores are comprised of a plurality of longitudinally extending parallel segments.

One skilled in the art will be able to construct variations and modifications of the multiple path sling construction of this invention in light of this enabling disclosure. It is understood that this invention may be practiced otherwise than specifically described herein yet still remain within the scope of the claims which define the invention.

What is claimed is:

1. A lifting sling which comprises at least two separate and distinct parallel endless load bearing cores, a seamless single tubular cover means which is bonded to form at least two channels in which said cores are located in an endless loop and separate from each other with said cover means also formed in an endless loop.

2. The sling construction of claim 1 wherein said cover means is bonded longitudinally along an intermediate portion between the two cores wherein the bonding means is not in contact with the load bearing core material to maintain separate channels for each load bearing core.

3. The sling construction of claim 2 which comprises an additional outer cover means.

4. The sling construction of claim 3 which comprises safety indicator means to show excessive wear on the outer cover means.

5. The sling construction of claim 4 in which said safety indicator means comprises an inner cover means having a different color from the outer cover means.

6. A heavy duty sling construction which comprises at least two sling constructions of claim 1 in which each load bearing core is separate and distinct and contained in an endless loop inside cover means which are also formed in endless loops.

7. The heavy duty sling construction of claim 6 which comprises outer cover means also formed in endless loops.

8. A method of constructing a lifting sling which comprises placing at least two separate and distinct cores of flexible load bearing material in parallel relationship laid end to end on a surface along a guide bar means mounted on said surface; sewing said cores at this distal ends to a holding means; pulling a seamless single tubular cover means having two ends over one end of said guide bar means to enclose said load bearing cores inside said cover means; sewing fastening means through said cover means longitudinally along an intermediate portion between the cores while keeping each core separate from the adjacent core so that the fastening means does not contact the core material; fastening the distal ends of each core together to form parallel endless loops of said cores; and fastening the distal ends of said cover means to form an endless loop.

9. The method of claim 8 which includes pulling and outer seamless tubular cover means having two ends over the first cover means; folding each end of said outer cover means back to expose the end surfaces of said inner and outer cover means together longitudinally along an intermediate portion between the cores; and fastening their distal ends together to form endless loops.

* * * * *